US012024850B2

(12) United States Patent
Horii

(10) Patent No.: US 12,024,850 B2
(45) Date of Patent: Jul. 2, 2024

(54) WORKING MACHINE AND CONTROL METHOD OF WORKING MACHINE

(71) Applicant: KUBOTA CORPORATION, Osaka (JP)

(72) Inventor: Hiroshi Horii, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 513 days.

(21) Appl. No.: 16/896,716

(22) Filed: Jun. 9, 2020

(65) Prior Publication Data

US 2020/0354920 A1 Nov. 12, 2020

Related U.S. Application Data

(63) Continuation of application No. PCT/JP2018/040859, filed on Nov. 2, 2018.

(30) Foreign Application Priority Data

Jan. 23, 2018 (JP) ..... 2018-009182

(51) Int. Cl.
*E02F 3/43* (2006.01)
*E02F 3/30* (2006.01)
*E02F 3/34* (2006.01)

(52) U.S. Cl.
CPC ..... *E02F 3/437* (2013.01); *E02F 3/301* (2013.01); *E02F 3/3414* (2013.01); *E02F 3/431* (2013.01)

(58) Field of Classification Search
CPC ..... E02F 3/437; E02F 3/301; E02F 3/3414; E02F 3/431; E02F 3/325; E02F 3/964; E02F 9/2033; E02F 3/435; E02F 3/00–3/968; E02F 3/40–3/48
USPC ..... 701/50
See application file for complete search history.

(56) References Cited

U.S. PATENT DOCUMENTS 5,525,028 A * 6/1996 Ogasawara ..... E02F 3/325 414/694
5,704,141 A * 1/1998 Miura ..... E02F 9/2033 37/348
5,957,989 A * 9/1999 Egawa ..... E02F 9/2033 701/50

(Continued)

FOREIGN PATENT DOCUMENTS

CN 113047367 A * 6/2021
GB 2 42 886 A 10/1991

(Continued)

OTHER PUBLICATIONS

Japanese Office Action for Japanese Application No. 2022-132565, dated Jan. 23, 2024, with an English translation.

*Primary Examiner* — Mohamed Abdo Algehaim
(74) *Attorney, Agent, or Firm* — BIRCH, STEWART, KOLASCH & BIRCH, LLP

(57) ABSTRACT

A working machine includes a controller device to set an allowable-stroke range of the arm cylinder moving the arm toward the boom depending on a turn position of the boom such that a shortest trajectory distance that is a shortest distance between the boom cylinder and a turn trajectory of the tip end portion of the bucket is kept at a predetermined value even when the turn position of the boom changes, in a case where the boom is turned in a direction separating from a boom reference position.

10 Claims, 8 Drawing Sheets

(56) References Cited

U.S. PATENT DOCUMENTS

| | | | | |
|---|---|---|---|---|
| 6,230,090 | B1 * | 5/2001 | Takahashi | E02F 3/435 701/50 |
| 9,315,969 | B2 * | 4/2016 | Uchiyama | E02F 3/307 |
| 9,580,886 | B2 * | 2/2017 | Nakagaki | E02F 9/2033 |
| 2009/0030580 | A1 * | 1/2009 | Doi | E02F 9/2033 701/50 |
| 2011/0264334 | A1 * | 10/2011 | Murota | E02F 9/2033 701/50 |
| 2012/0024146 | A1 * | 2/2012 | Saito | E02F 9/2296 91/525 |
| 2015/0147147 | A1 * | 5/2015 | Uchiyama | E02F 9/2033 414/685 |
| 2015/0368876 | A1 * | 12/2015 | Nakagaki | E02F 9/2033 701/50 |
| 2017/0306587 | A1 * | 10/2017 | Hosaka | E02F 9/264 |
| 2019/0024348 | A1 * | 1/2019 | Hiekata | E02F 9/24 |
| 2019/0194905 | A1 * | 6/2019 | Matsuyama | E02F 9/2041 |
| 2020/0370269 | A1 * | 11/2020 | Wagner | E02F 3/42 |
| 2021/0262191 | A1 * | 8/2021 | Ito | E02F 9/2228 |

FOREIGN PATENT DOCUMENTS

| | | | | |
|---|---|---|---|---|
| JP | 7-109750 | A | 4/1995 | |
| JP | 8-284199 | A | 10/1996 | |
| JP | H1193199 | A * | 9/1997 | |
| JP | 10-204933 | A | 8/1998 | |
| JP | 11-93199 | A | 4/1999 | |
| JP | 3602770 | B2 * | 12/2004 | |
| JP | 2005-248502 | A | 9/2005 | |
| JP | 2010-163772 | A | 7/2010 | |
| JP | 2010163772 | A * | 7/2010 | E02F 3/301 |
| JP | 5548368 | B2 * | 7/2014 | |
| JP | 2017-65569 | A | 4/2017 | |
| JP | 2017-133261 | A | 8/2017 | |
| WO | WO-2009145000 | A1 * | 12/2009 | E02F 3/301 |
| WO | WO 2017/170243 | A1 | 10/2017 | |

* cited by examiner

WORKING MACHINE AND CONTROL METHOD OF WORKING MACHINE

CROSS-REFERENCE TO RELATED APPLICATIONS

The present application is a continuation application of International Application No. PCT/JP 2018/040859, filed Nov. 2, 2018, which claims priority to Japanese Patent Application No. 2018/009182, filed Jan. 23, 2018. The contents of these applications are incorporated herein by reference in their entirety.

BACKGROUND OF THE INVENTION

Field of the Invention

The present invention relates to a working machine such as a backhoe.

Description of Related Art

The working machine disclosed in Japanese Unexamined Patent Publication No. 2017-65569 is previously known.

The working machine disclosed in Japanese Unexamined Patent Publication No. 2017-65569 is a backhoe including a machine body, a boom mounted on the machine body, an arm swingably supported by the boom, and a bucket provided at a tip end portion of the arm. In the working machine, the boom, arm, and bucket can be swung by respectively stretching and shortening the boom cylinder, arm cylinder, and bucket cylinder.

SUMMARY OF THE INVENTION

A working machine according to one aspect of the present invention, including: a machine body; a boom pivotally having a base end portion pivotally supported by the machine body to turn about a first turn shaft; a boom cylinder to turn the boom around the first turn shaft, the boom cylinder being arranged on one surface side of the boom; an arm having a base end portion pivotally supported by a tip end portion of the boom to turn about a second turn shaft parallel to the first turn shaft; an arm cylinder to turn the arm about the second turn shaft, the arm cylinder being arranged on the other surface side of the boom; and a working tool pivotally supported by a tip end portion of the arm to turn about a third turn shaft parallel to the first turn shaft, includes a controller device to set an allowable-stroke range of the arm cylinder moving the arm toward the boom depending on a turn position of the boom such that a shortest trajectory distance that is a shortest distance between the boom cylinder and a turn trajectory of the tip end portion of the working tool about the third turn shaft is kept at a predetermined value even when the turn position of the boom changes, in a case where the boom is turned in a direction separating from a boom reference position. The boom reference position is the turn position of the boom where a first straight line connecting the first turn shaft and a fourth turn shaft is perpendicular to a second straight line parallel to an extending direction of the boom cylinder, the fourth turn shaft being provided on the base end portion side of the boom and rotatably supporting the boom cylinder.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
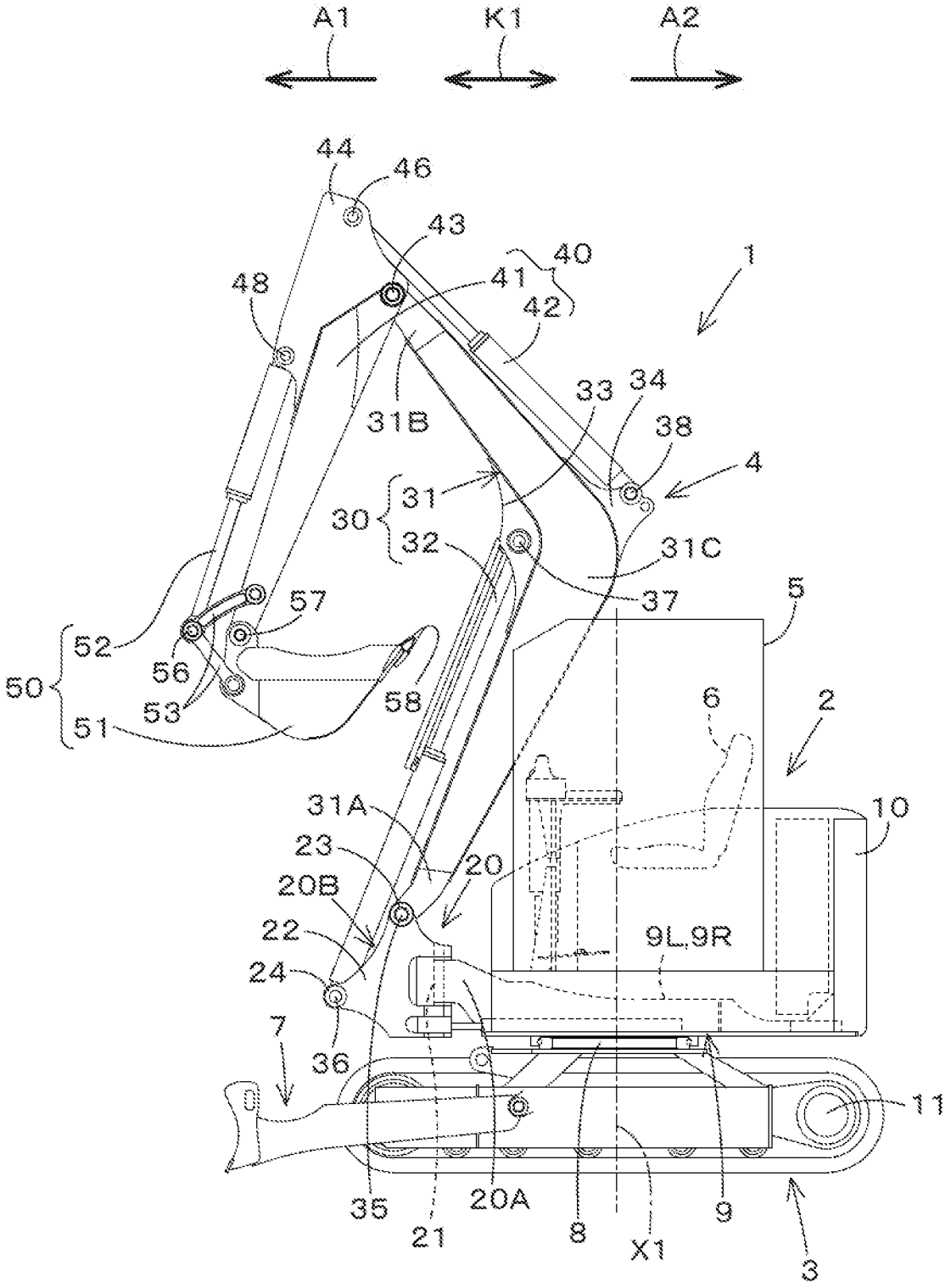
FIG. 1 is a side view of a working machine according to embodiments of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described with appropriate reference to the drawings.

First Embodiment

An embodiment of the present invention will be described below.

(1-1. Overall Configuration of Working Machine 1)

FIG. 1 is a schematic side view of a working machine 1 according to the embodiment. In the present embodiment, a backhoe that is a swivel working machine is exemplified as the working machine 1.

As shown in FIG. 1, the working machine 1 includes a machine body (a turn base) 2, a traveling device 3, and a working device 4. A cabin 5 is mounted on the machine body 2. An operator seat (a seat) 6 on which a driver (an operator) sits is provided inside the cabin 5.

In the present embodiment, the front side of the operator sitting on the operator seat 6 (a direction indicated by an arrowed line A1 in FIG. 1) is referred to as the front, the rear side of the operator (a direction indicated by an arrowed line A2 in FIG. 1) is referred to as the rear, the left side of the operator is referred to as the left, and the right side of the operator is referred to as the right. Additionally in the explanation, as shown in FIG. 1, the horizontal direction, which is a direction orthogonal to the front-rear direction K1, will be described as a machine width direction (a width direction of the machine body 2).

As shown in FIG. 1, the traveling device 3 is a device for supporting the machine body 2 and is configured to perform the traveling. The traveling device 3 is driven by a traveling motor 11 constituted of a hydraulic motor (a hydraulic actuator) or an electric motor. The present embodiment employs the traveling device 3 of crawler type. However, not limited to this configuration, a traveling device of wheel type or the like may be employed.

A dozer device 7 is attached to the front portion of the traveling device 3. The dozer device 7 is configured to move up and down (to raise and lower) the blade (an earth-dumping plate) 74 by stretching and shortening a dozer cylinder (a hydraulic actuator) not shown in the drawings.

The machine body 2 is supported on the traveling device 3 with a turn bearing 8 so as to be turned around a turn axis X1. The swivel axis X1 is an axial center extending in the vertical direction that passes through the center of the swivel bearing 8. A prime mover is mounted on the machine body 2. The prime mover is a diesel engine. The prime mover may be a gasoline engine, an LPG engine, or an electric motor, or may be a hybrid type having an engine and an electric motor.

The machine body 2 has a turn base plate 9 that turns around the turn axis X1. The turn base plate 9 is made of a steel plate or the like, and constitutes the bottom of the machine body 2. The prime mover is mounted on the turn base plate 9. Vertical ribs 9L and 9R, which are reinforcing members, are provided on the center side of the upper surface of the turn base plate 9, extending from the front portion to the rear portion.

A weight 10 is provided at the rear portion of the machine body 2.

A support body 20 configured to support the working device 4 is provided at the front portion of the machine body 2. The support body 20 has a support bracket 20A and a swing bracket 20B. The support bracket 20A is fixed to the front portions of the vertical ribs 9L and 9R, and is provided so as to protrude forward from the machine body 2. A swing bracket 20B is attached to a front portion (a portion protruding from the machine body 2) of the support bracket 20A so as to be swingable around a vertical axis with a swing shaft 21. Thus, the swing bracket 20B is rotatable in the machine width direction K2 (horizontally around the swing shaft 21).

The swing bracket 20B is provided with a first pivotally-supporting portion 23 having a tubular shape provided on the upper portion of the main body 22 and is provided with a second pivotally-supporting portion 24 having a tubular shape provided on the lower portion of the main body 22.

The working device 4 includes a boom device 30, an arm device 40, and a working tool device 50. The boom device 30 has a boom 31 and a boom cylinder 32. The boom 31 includes a base portion 31A swingably (rotatably) supported with a horizontal shaft (a first rotation shaft) 35 that extends in the machine body width direction K2 of the first pivot portion 23 of the swing bracket 20B, a tip end portion 31B swingably supporting the arm 41, and an middle portion 31C provided between the base portion 31A and the tip portion 31B. The middle portion 31C has a long shape extending along the longitudinal direction, and is bent downward at an intermediate portion. The lower bracket 33 is provided on one side (a lower side) of the bent portion of the middle portion 31C, and the upper bracket 34 is provided on the other side (an upper side) of the bent portion of the middle portion 31C.

The boom cylinder 32 is a hydraulic cylinder to be stretched and shortened to swing (to rotate) the boom 31, and includes a cylinder portion 32A having a cylindrical shape and a rod 32B whose one end side is slidably inserted into the cylinder portion 32A. A surface of the boom cylinder 32 on the arm 41 side (a lower side) may be provided with a guard member (a cylinder guard) that prevents the rod 32B and/or the cylinder portion 32A from contacting to another object. The base end portion of the boom cylinder 32 is swingably supported by a horizontal shaft (a fourth rotation shaft) 36 of the second pivot portion 24, and the tip end portion of the boom cylinder 32 swingably supported by a horizontal shaft 37 of the lower bracket 33. Thus, the boom device 30 (the boom 31) is configured to turn around the horizontal shaft 35 on the first pivotally supporting portion 23, and the boom device 30 (the boom 31) is configured to turn upward and downward.

The arm device 40 has the arm 41 and the arm cylinder 42. The arm 41 is elongated along the longitudinal direction. A base end portion of the arm 41 is swingably supported by a tip end portion 31B of the boom 31 with a horizontal shaft (a second rotation shaft) 43. An upper bracket 44 is provided on the upper surface side of the base end portion of the arm 41.

The arm cylinder 42 is a hydraulic cylinder configured to stretched and shortened to swing the arm 41. The base end portion of the arm cylinder 42 is swingably supported by the horizontal shaft 38 of the upper bracket 34 of the boom 31, and the tip end portion of the arm cylinder 42 is swingably supported by the horizontal shaft 46 of the upper bracket 44. Thus, the arm device 40 (the arm 41) is rotatable around the horizontal axis 43 on the boom 31, and the arm device 40 (the arm 41) is swingable upward or downward.

The working tool device 50 has a bucket 51 as a working tool and has a bucket cylinder 52 as a working tool cylinder. The bucket 51 is swingably supported by the tip end portion of the arm 41 with a horizontal axis (a third rotation axis) 57. A link mechanism 53 is provided between the bucket 51 and the tip of the arm 41.

The bucket cylinder 52 is constituted of a hydraulic cylinder configured to stretch and shorten to swing the bucket 51. The base end portion of the bucket cylinder 52 is swingably supported by the horizontal shaft 48 of the upper bracket 44 of the arm 41, and the tip end portion of the bucket cylinder 52 is swingably supported by the horizontal shaft 56 of the link mechanism 53. Thus, the working tool device 50 (the bucket 51) is provided on the tip end side of the arm 41 so as to perform the squeezing operation and the dumping operation. The squeezing operation is an operation of swinging the tip end portion 58 of the bucket 51 in a direction of approaching the boom 31 (a direction of squeezing), for example, an operation of scooping earth and sand or the like. In addition, the dumping operation is an operation of swinging the tip end portion 58 of the bucket 51 in a direction separating away from the boom 31 (a direction of dumping), for example, an operation of dropping (discharging) the scooped earth and sand.

Instead of or in addition to the bucket 51, the working machine 1 can be equipped with another working tool (a hydraulic attachment) configured to be driven by a hydraulic actuator. Examples of other working tools include a hydraulic breaker, a hydraulic crusher, an angle broom, an earth auger, a pallet fork, a sweeper, a mower, and a snow blower.

(1-2. Configurations of Hydraulic System and Control System in Working Machine 1)

Figure 2:
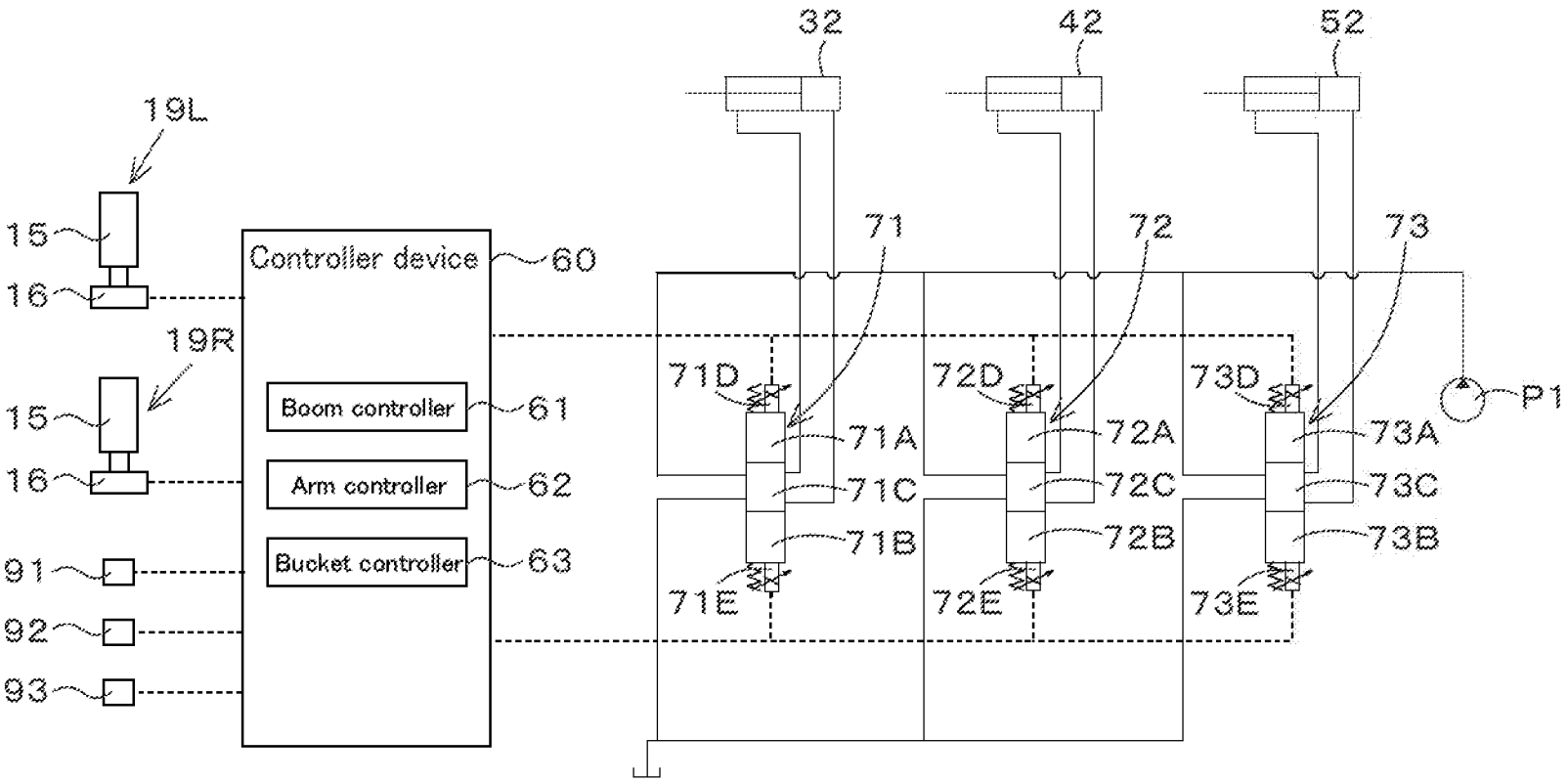
FIG. 2 is a schematic diagram of a hydraulic system for the working machine according to the embodiments.

FIG. 2 is a diagram showing a hydraulic system for the working machine 1, the hydraulic system being configured to operate the working device 4.

As shown in FIG. 2, the hydraulic system for the working machine 1 includes a boom control valve 71, an arm control valve 72, a bucket control valve 73, a controller device 60, controller devices 19L and 19R, a boom angle sensor 91, an arm angle sensor 92, and a working tool angle sensor 93.

The boom control valve 71, the arm control valve 72, and the bucket control valve 73 are respectively connected to the boom cylinder 32, the arm cylinder 42, and the bucket cylinder 52 by fluid tubes. The boom control valve 71, the arm control valve 72, and the bucket control valve 73 are each connected to a hydraulic pump P1 configured to output operation fluid through a fluid tube.

The boom control valve 71, the arm control valve 72, and the bucket control valve 73 are, for example, electromagnetic three-position switching valves.

In particular, the boom control valve 71 can be switched between the first position 71A, the second position 71B, and the third position 71C by magnetizing and demagnetizing the first solenoid 71D and the second solenoid 71E. When the boom control valve 71 is switched to the first position 71A, the boom cylinder 32 is stretched by the supplying and outputting of the operation fluid to the boom cylinder 32, and thus the boom 31 swings in the lifting direction. On the other hand, when the boom control valve 71 is switched to the second position 71B, the boom cylinder 32 is shortened due to the supplying and outputting of the operation fluid to the boom cylinder 32, and thus the boom 31 swings in the lowering direction.

The arm control valve 72 is configured to be switched between the first position 72A, the second position 72B, and the third position 72C by magnetizing or demagnetizing the first solenoid 72D and the second solenoid 72E. When the arm control valve 72 is switched to the first position 72A, the arm cylinder 42 is stretched by the supplying and outputting of operation fluid to the arm cylinder 42, and thus the arm 41 swings backward and downward. On the other hand, when the arm control valve 72 is switched to the second position 72B, the arm cylinder 42 is shortened due to the supplying and outputting of the operation fluid to the arm cylinder 42, and thus the arm 41 swings forward and upward.

The bucket control valve 73 is configured to be switched between the first position 73A, the second position 73B, and the third position 73C by magnetizing and demagnetizing the first solenoid 73D and the second solenoid 73E. When the bucket control valve 73 is switched to the first position 73A, the bucket cylinder 52 is stretched due to the supplying and outputting of the operation fluid to the bucket cylinder 52, and thus the bucket 51 swings in the direction of squeezing. On the other hand, when the bucket control valve 73 is switched to the second position 73B, the bucket cylinder 52 is shortened due to the supplying and outputting of the operation fluid to the bucket cylinder 52, and thus the bucket 51 swings in the direction of dumping.

The controller device 60 includes a boom controller portion 61, an arm controller portion 62, and a bucket controller portion 63, and controls the switching operation of the boom control valve 71, the arm control valve 72, and the bucket control valve 73. That is, the controller device 60 controls the operations of the boom 31, the arm 41, and the bucket 51. The controller device 60 may be realized by a logic circuit (a hardware) formed on an integrated circuit (an IC chip) or the like, or may be realized by software using a computer. In the latter case, the computer includes a storage medium that stores a computer program that is software providing each function of the controller device 60 and various data related to the working machine 1 in a computer-readable manner, includes a calculation circuit such as a CPU (a Central Processing Unit) that executes the commands of the computer program, and includes a RAM (Random Access Memory) for exploding the computer program and various data. Then, the functions of the controller device 60 are realized by the calculation circuit reading the computer program from the recording medium and executing the computer program.

The controller device 60 is connected to the controller devices 19L and 19R that are held by the operator during the operation. The controller devices 19L and 19R are provided near the operator seat 6, respectively. Each of the controller devices 19L and 19R includes an operation lever 15 and a position sensor 16. The operation lever 15 is configured to be swung from the neutral position to the front, rear, right, and left. The position sensor 16 detects a swing amount (an operation extent) of the operation lever 15 from the neutral position to the front, rear, right, and left.

For example, when the operator swings the operation lever 15 of the control device 19R forward or backward, the swing amount detected when swinging the operating lever 15 forward or backward is inputted to the controller device 60. The controller device 60 switches the boom control valve 71 by magnetizing or demagnetizing the first solenoid 71D and the second solenoid 71E according to the swing direction and the swing amount of the operation lever 15. In addition, when the operator swings the operation lever 15 of the control device 19L forward or backward, the swing amount at the time of swinging forward or backward is inputted to the controller device 60. The controller device 60 switches the arm control valve 72 by magnetizing or demagnetizing the first solenoid 72D and the second solenoid 72E according to the swing direction and the swing amount of the operation lever 15. In addition, when the operator swings the operation lever 15 of the control device 19R left or right, the swing amount detected when swinging the operating lever 15 left or right is inputted to the controller device 60. The controller device 60 switches the bucket control valve 73 by magnetizing or demagnetizing the first solenoid 73D and the second solenoid 73E according to the swing direction and the swing amount of the operation lever 15.

In addition, the controller device 60 includes a boom angle sensor 91 configured to detect a swing angle θ2 (a turn position) of the boom 31, an arm angle sensor 92 configured to detect a swing angle θ3 (a turn position) of the arm 41, and a working tool angle sensor 93 configured to detect a swing angle θ4 (a turn position) around the horizontal axis 57 of the bucket 51 with respect to the tip end of the arm 41. In the present embodiment, potentiometers are employed as the boom angle sensor 91, the arm angle sensor 92, and the working tool angle sensor 93, but the present invention is not limited to those sensors, and other angle sensors may be employed. The swing angles of the boom 31, the arm 41, and the bucket 51 may be calculated from the detection result of the stroke (the stretching position) of the boom cylinder 32, the arm cylinder 42 and the bucket cylinder 52.

(1-3. Movement Control of Arm Cylinder)

(1-3-1. Setting Reference Distance L1)

Next, movement control of the arm cylinder 42 in the working machine 1 will be described below. First, a method for setting the allowable-stroke range of the arm cylinder 42 under the state where the boom device 30 (the boom 31) is at the boom reference position S1 will be described.

Figure 3:
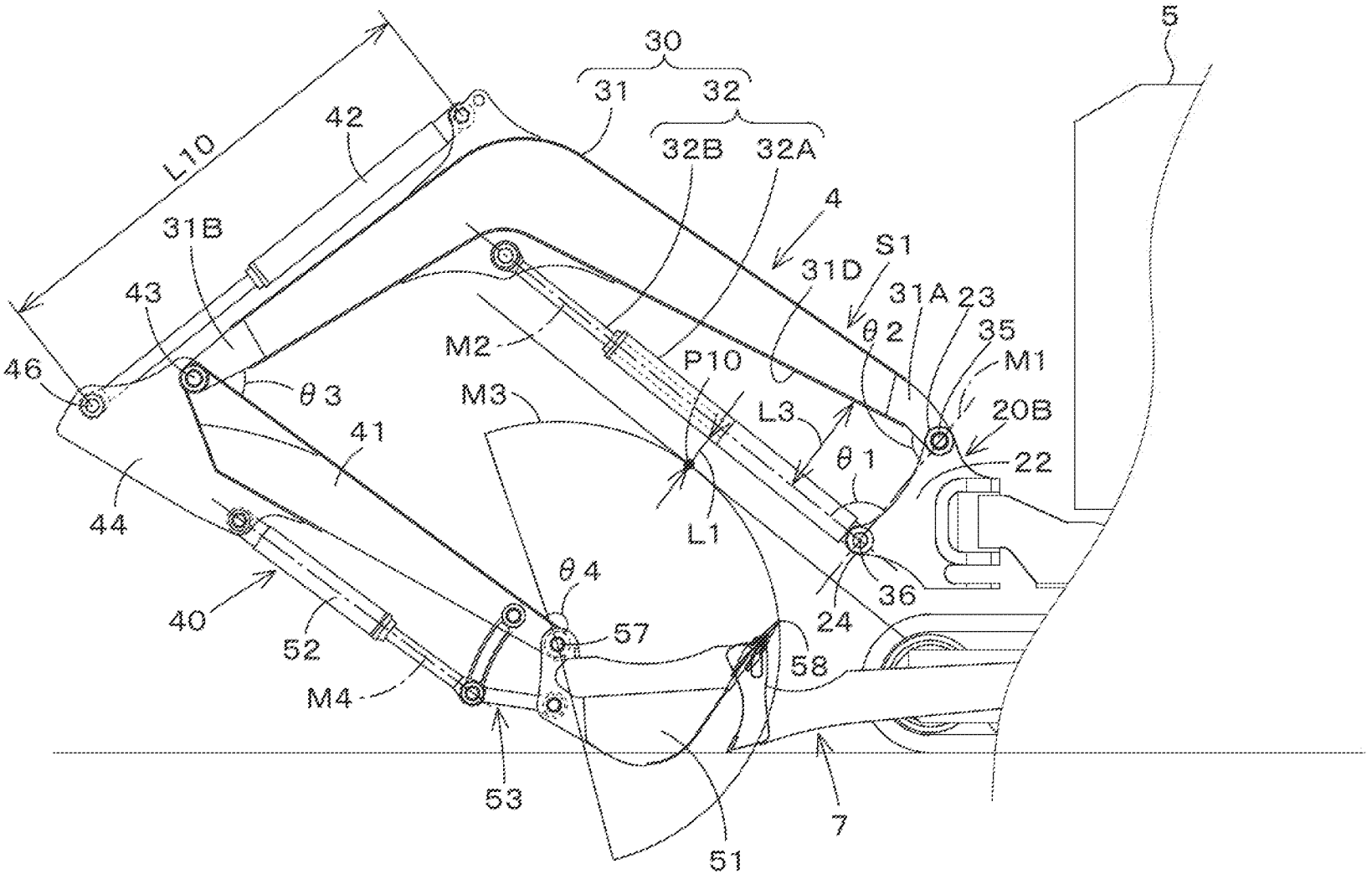
FIG. 3 is a side view of the working machine in a case where a boom is located at a boom reference position S1 according to the embodiments.

As shown in FIG. 3, the controller device 60 (the arm controller portion 62) sets a stretching range of the arm cylinder 42 (the allowable-stroke range where the arm 41 approaches the boom cylinder 32 side) such that the distance between the boom device 30 and the tip end portion 58 of the bucket 51 becomes the reference distance (a predetermined value) L1 for avoiding the interference between the boom device 30 and the tip end portion 58 of the bucket 51 under the state where the boom device 30 (the boom 31) is at the boom reference position S1. The value of the reference distance L1 may be a fixed value set as a default value, or may be arbitrarily changed.

The boom reference position S1 is the turn position of the boom 31 wherein the shortest trajectory distance, which is the shortest distance between the boom cylinder 32 and a turn trajectory M3 around the horizontal axis 57 of the tip end portion 58 of the bucket 51, becomes the minimum value when the boom 31 is rotated around the horizontal axis 35 while keeping the stroke of the arm cylinder 42 constant. In other words, the boom reference position S1 is the boom position (a boom angle) where the distance between the boom cylinder 32 and the lower surface 31D of the boom 31 is the largest.

In the present embodiment, in the swing bracket 20B at the boom reference position S1, an angle θ1 is substantially a right angle, the angle θ1 being formed by: a first straight line M1 that connects between the center of the horizontal shaft 35 of the first pivotally supporting portion 23 that swingably supports the base end portion of the boom 31 and the center of the horizontal shaft 36 of the second pivotally supporting portion 24 that swingably supports the base end portion of the boom cylinder 32; and a second straight line M2 that is a straight line passing through the center of the horizontal shaft 36 and is parallel to the extending direction (the axial direction) of the boom cylinder 32.

As described above, the controller device (the arm controller portion 62) 60 sets the extendable range of the arm cylinder 42 so that the shortest trajectory distance at the boom reference position S1 becomes the reference distance L1. That is, the controller device (the arm controller portion 62) 60 sets the allowable-stroke range of the arm cylinder 42 such that the shortest trajectory distance, which is the distance between the boom device 30 (the boom cylinder 32) and the proximity point P10 most close to the boom device 30 (the boom cylinder 32) in the turn trajectory M3 of the tip end portion 58 provided when the bucket 51 is swung under the state where the boom 31 is at the boom reference position S1.

Although the reference distance L1 is set to 80 mm in the present embodiment, the reference distance L1 is not limited to that value. The reference distance L1 may be set to be as short as possible within a range in which the contacting between the boom cylinder 32 and the bucket 51 can be appropriately prevented, and is preferably set within a range between 50 mm or more and 120 mm or less, for example. More preferably, it is set within the range between 60 mm or more and 100 mm or less.

In the present embodiment, the arm cylinder 42 has a margin for further stretching in the direction of making the shortest trajectory distance shorter than the reference distance L1 at the boom reference position S1, but the controller device (the arm controller portion 62) 60 limits the allowable-stroke range (the extendable range) of the arm cylinder 42 such that the shortest trajectory distance does not become less than the reference distance L1. In this manner, as shown in FIG. 3, when the boom 31 is at the boom reference position S1, the tip end portion 58 of the bucket 51 is prevented from contacting to the boom device 30 (the boom cylinder 32 even when the bucket 51 is swung.

(1-3-2. In Movement in a Direction Separating Away from the Boom Reference Position)

Next, the movement control of the arm cylinder 42 to be performed when the boom 31 is moved in the direction separating away from the boom reference position S1 will be described below.

Figure 4:
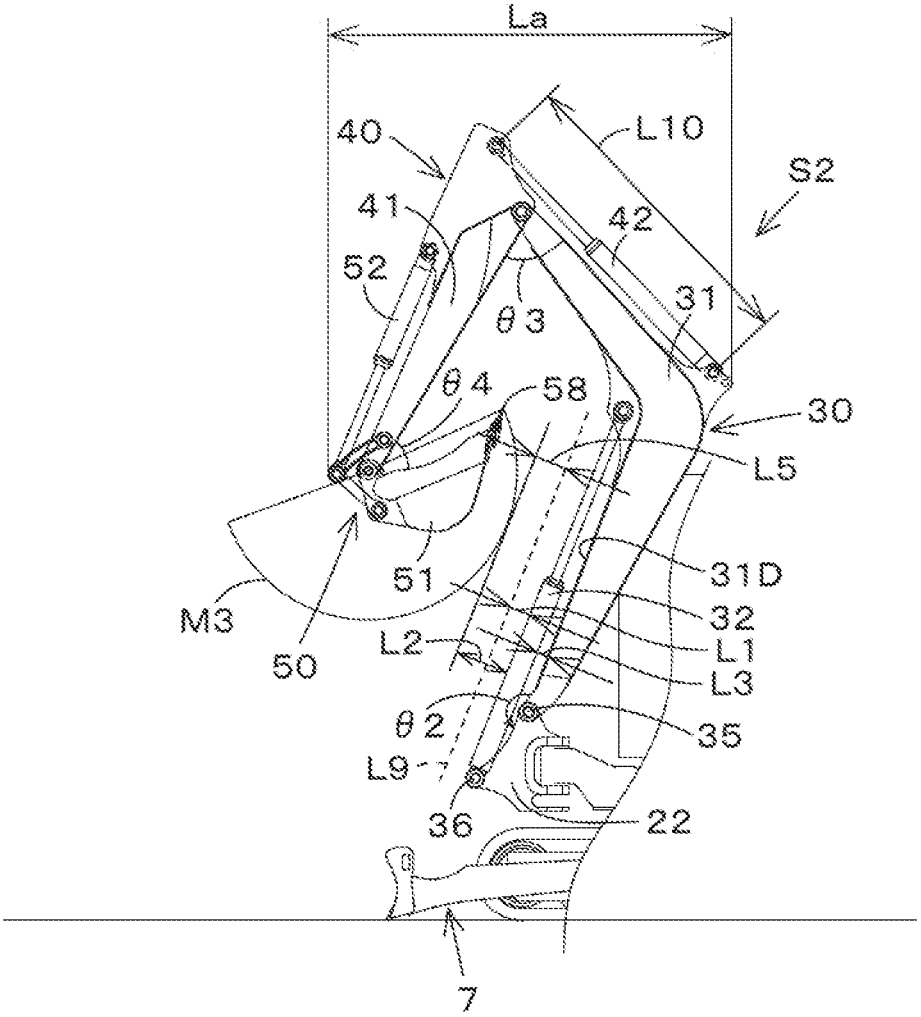
FIG. 4 is a side view of the working machine under a state where the boom is turned upward from the boom reference position S1 with a stroke of an arm cylinder constant according to the embodiments.

FIG. 4 shows the boom swing position S2 in the case of performing the conventional control in which the boom 31 is swung upward while the stroke of the arm cylinder 42 is kept constant from the state where the arm cylinder 42 is stretched so that the shortest trajectory distance becomes the reference distance L1 at the boom reference position S1. In this state, the shortest trajectory distance L2 between the turn trajectory M3 of the tip end portion 58 of the bucket 51 and the boom cylinder 32 is longer than the reference distance L1.

On the other hand, in the present embodiment, the arm controller portion 62 (the controller device 60) sets the allowable-stroke range of the arm cylinder 42 (the allowable-stroke range where the arm 41 is moved to the boom 31) depending on the turn position of the boom 31 when the boom 31 is turned away from the arm reference position S1, such that the shortest trajectory distance that is the shortest distance between the turn trajectory M3 of the tip end portion 58 of the bucket 51 is kept at the reference distance L1.

In particular, when the operator operates the boom 31 with the control device 19R, the boom controller portion 61 operates the boom 31 according to the operation of the operator. In addition, the arm controller portion 62 sets the allowable-stroke range of the arm cylinder 42 based on the relation between the detection result of the turn position of the boom 31 by the boom angle sensor 91 and the preliminarily stored allowable-stroke range of the arm cylinder 42 for setting a distance between the turn position of the boom 31 and the shortest trajectory distance to the reference distance L1.

More In particular, the arm controller portion 62 refers to the swing angle θ2 (the turn position) of the boom 31 inputted from the boom angle sensor 91 and to the turn operation direction of the boom 31 by the operator, and judges whether the operation is performed in the direction of moving the boom 31 away from the reference position S1. When the arm controller portion 62 determines that the operation is performed in the direction of moving the boom 31 away from the boom reference position S1, the arm controller portion 62 refers to a table or a function showing the relationship between the turn position of the boom 31 and the allowable-stroke range of the arm cylinder 42 for setting the shortest trajectory distance to the reference distance L1, and sets the allowable-stroke range of the arm cylinder 42 on the basis of the reference result.

Figure 5:
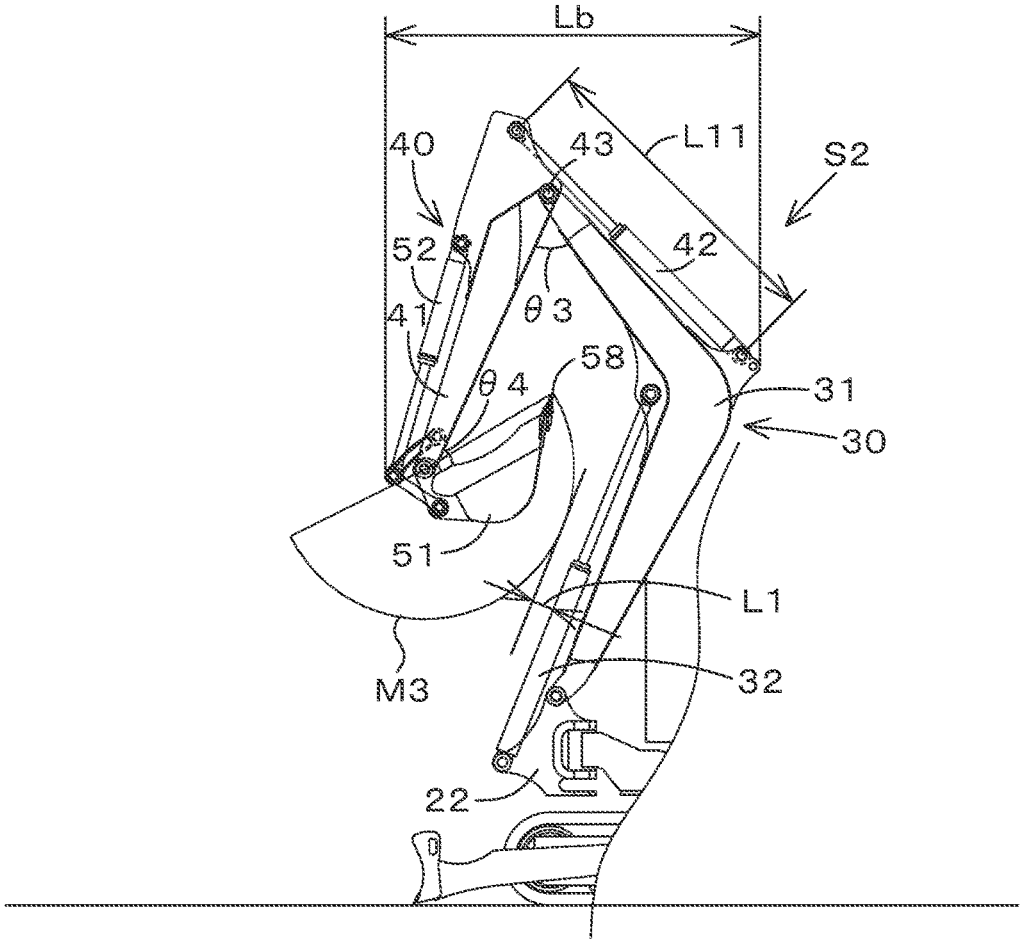
FIG. 5 is a side view of the working machine under a state where the boom is turned upward from the boom reference position S1 with an allowable-stroke range of the arm cylinder changed depending on a turn position of the boom such that a distance between the boom cylinder and a turn trajectory of a working tool is kept constantly at a reference distance according to the embodiments.

In this manner, for example, when the operator operates the arm 41 in the direction to bring the arm 41 closer to the boom cylinder 32 with the control device 19L at the boom swing position S2 described above, the arm cylinder 42 is allowed to be stretched to the shortest trajectory distance matching the reference distance L1 as shown in FIG. 5. That is, assuming that the maximum length of the arm cylinder 42 being when the conventional control shown in FIG. 4 is performed is represented by a reference numeral L10, and the maximum length of the arm cylinder 42 being when the control of the present embodiment shown in FIG. 5 is performed is L11, a relation, L11>L10 is satisfied.

As the result, as shown in FIG. 5, the arm 41 and the bucket 51 can be sufficiently brought closer to the boom 31 side regardless of the posture of the boom 31, and the length Lb of the working device 4 in the front-rear direction can be set to be shorter than the length La of the arm cylinder 42 (see FIG. 4) obtained when the allowable-stroke range is kept at the same constant value as the boom reference position S1.

FIG. 4 and FIG. 5 show an example in which the boom 31 is turned upward from the boom reference position S1. However, the arm controller portion 62 (the controller device 60) performs the same control even when the boom 31 is moved downward from the boom reference position S1. That is, when the boom 31 is swung in a direction separating downward away from the boom reference position S1, the controller device 60 sets the allowable-stroke range of the arm cylinder 42 (the allowable-stroke range of the arm cylinder 42 to move the arm 41 closer to the boom 31) such that the shortest trajectory distance between the turn trajectory M3 of the tip end portion 58 of the bucket 51 and the boom cylinder 32 is maintained at the reference distance L1. In this manner, even when the boom 31 is turned in the lowering direction from the boom reference position S1, the tip end portion 58 of the bucket 51 can be brought close to a position where the tip end portion 58 of the bucket 51 approaches or abuts on the blade 74 of the dozer device 7. Thus, it is possible to easily scoop off the soil and the like with the bucket 51 and the blade 74 of the dozer device 7 (so-called the dust removing work).

(1-3-3. In Movement in a Direction Approaching the Boom Reference Position)

Next, the movement control of the arm cylinder 42 performed when the boom 31 is operated in the direction of approaching the boom reference position S1 will be described below.

Figure 6:
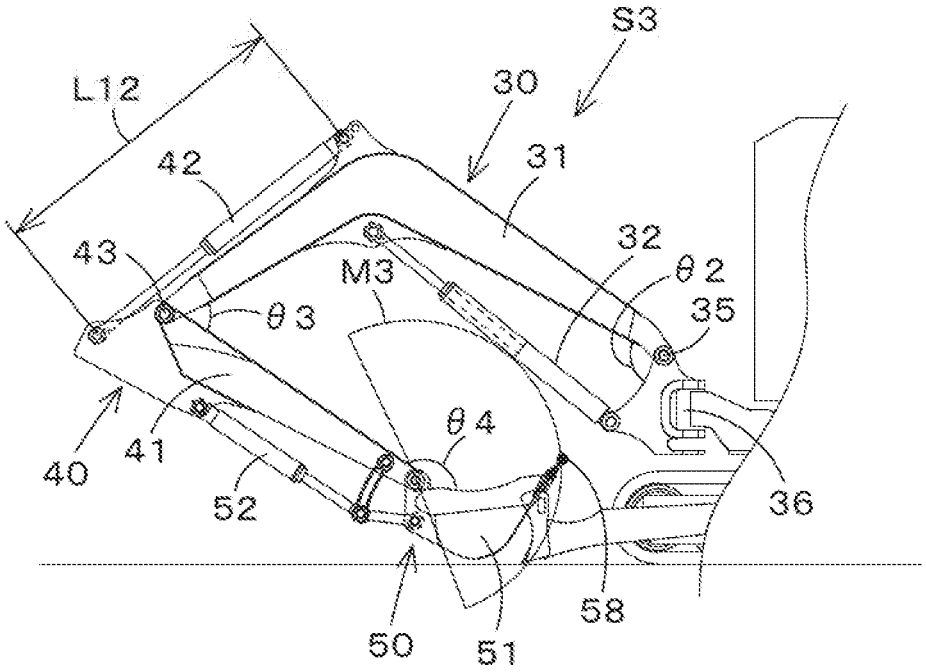
FIG. 6 is a side view of the working machine under a state where the boom is turned in a direction where the boom approaches the boom reference position S1 from the state of FIG. 5 with a stroke of the arm cylinder constant according to the embodiments.

FIG. 6 shows a state where, while keeping the allowable-stroke range of the arm cylinder 42 constant within the allowable-stroke range of the arm cylinder 42 set at the boom swing position S2, the boom 31 is turned from the boom swing position S2 to the boom swing position S3 closer to the boom reference position S1 than the boom swing position S2. That is, FIG. 6 shows a state where the boom 31 is turned from the boom swing position S2 to the boom swing position S3 while the maximum length L12 of the arm cylinder 42 is kept constant (L12=L11) at the maximum length L11 of the arm cylinder 42 set at the boom swing position S2 (see FIG. 5).

As shown in FIG. 6, when the boom 31 is brought closer to the boom reference position S1 while keeping the allowable-stroke range within the range set at the boom swing position S2, the boom cylinder 32 enters in the turn trajectory M3 of the tip end portion 58 of the bucket 51. Thus, there is a case where the boom cylinder 32 and the tip end portion 58 of the bucket 51 interfere with each other.

On the other hand, in the present embodiment, in the case where the arm controller portion 62 (the controller device 60) turns the boom 31 in the direction approaching the boom reference position S1, and in the case where the shortest trajectory distance that is the shortest distance between the boom cylinder 32 and the turn trajectory M3 of the tip end portion 58 of the bucket 51 is less than the reference distance L1 when only the boom 31 is moved without moving the arm cylinder 42, the arm cylinder 42 is operated to retract the arm in the direction in which the tip end portion 58 of the bucket 51 moves away from the boom cylinder 32.

In particular, when the operator operates the boom 31 by the control device 19R, the boom controller portion 61 operates the boom 31 according to the operation of the operator. In addition, the arm controller portion 62 refers to the swing angle θ2 (the turn position) of the boom 31 inputted from the boom angle sensor 91 and to the turn operation direction of the boom 31 by the operator, and judges whether the operation moves the boom 31 in the direction approaching the boom reference position S1.

When the arm controller portion 62 determines that the operation is in the direction of moving the boom 31 closer to the boom reference position S1, the arm controller portion 62 judges whether the shortest trajectory distance becomes less than the reference distance L1 when only the boom 31 is operated without operating the arm cylinder 42, based on the detection result of the turn position of the boom 31 by the boom angle sensor 91 and on the detection result of the turn position of the arm 41 by the arm angle sensor 92. Then, when it is determined that the distance is less than the reference distance L1, the arm controller portion 62 operates (shortens) the arm cylinder 42 until the shortest trajectory distance becomes the reference distance L1, and retracts the arm 41 in a direction where the tip end portion 58 of the bucket 51 moves away from the boom cylinder 32. That is, the arm controller portion 62 refers to the table or the function representing the relation between the turn position of the boom 31 and the turn position of the arm 41, specifies the stroke amount (the shortening amount) of the arm cylinder 42 for setting the shortest trajectory distance to the reference distance L1, and then the arm cylinder 42 is operated according to the specified stroke amount. In this manner, the boom cylinder 32 and the bucket 51 can be prevented from interfering with each other.

(1-3-4. Electronic Cushion)

In addition, when the arm cylinder 42 is stretched beyond the allowable-stroke range set at the boom reference position S1, the arm controller portion 62 performs an electric cushion control to restrict the operating speed of the arm cylinder 42 rather than the stretching within the allowable-stroke range. In particular, in the case where the arm controller portion 62 extends the arm cylinder 42 beyond the allowable-stroke range set at the boom reference position S1 while turning the boom 31 in a direction separating away from the boom reference position S1, the arm controller portion 62 reduces a pilot pressure to be supplied to the pressure receiving portion (a pilot pressure receiving portion) of the control valve 72. In this manner, the configuration makes it possible to easily limit the operation speed of the arm cylinder 42 at the end portion of the allowable-stroke range regardless of the setting status of the allowable-stroke range of the arm cylinder 42.

Second Embodiment

Another embodiment of the present invention will be described below. For convenience of the explanation, members having the same functions as those according to the first embodiment are represented with the same reference numerals, and the description thereof will be omitted.

In the first embodiment, the example in which the allowable-stroke range of the arm cylinder 42 is set depending on the turn position of the boom 31 has been described. On the other hand, in the present embodiment, the allowable-stroke range of the arm cylinder 42 is set based on the turn position of the boom 31 and on the turn position of the bucket 51.

(2-1. Initial Setting of Allowable-Stroke Range of Arm Cylinder)

Figure 7:
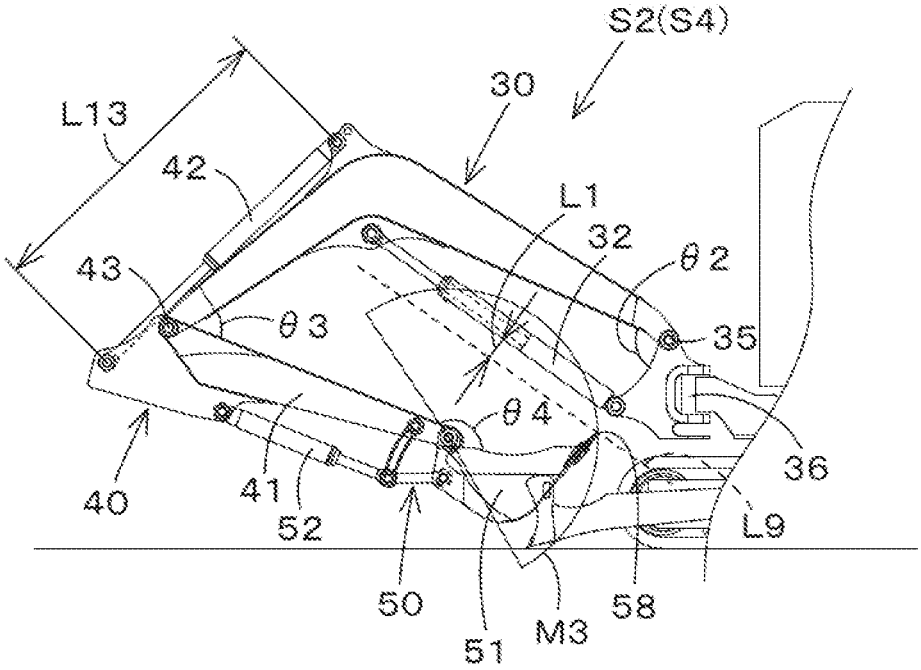
FIG. 7 is a side view of the working machine illustrating a method for setting the allowable-stroke range of the arm cylinder such that a distance between the boom cylinder and the tip end portion of a bucket is equal to or more than the reference distance according to the embodiments.

First, the arm controller portion 62 calculates the tip distance which is the distance between the tip end portion 58 of the bucket 51 and the boom cylinder 32 in the current swing posture, based on the detection result of the swing angle θ2 (the turn position) of the boom 31 detected by the boom angle sensor 91, on the detection result of the swing angle θ3 (the turn position) of the arm 41 detected by the arm angle sensor 92, and on the detection result of the swing angle θ4 (the turn position) of the bucket 51 detected by the working tool angle sensor 93. Then, the arm controller portion 62 sets the allowable-stroke range of the arm cylinder 42 (the allowable-stroke range where the arm 41 approaches the boom 31 side) to allow the arm cylinder 42 to be stroked to a position where the calculated tip end distance becomes the reference distance L1, as shown in FIG. 7. In this manner, as shown in FIG. 7, the maximum length L13 of the arm cylinder 42 is set to be longer than the maximum length L11 of the arm cylinder 42 set at the boom swing position S2 (see FIG. 5) in the first embodiment base on the swing angle θ4 of the bucket 51. Thus, it is possible to set the arm 41 and the bucket 51 closer to the boom 31 side than in the first embodiment.

(2-2. Movement in Direction Separating Away from Boom Reference Position)

When the arm controller portion 62 turns the boom 31 in a direction separating away from the arm reference position S1, the arm controller portion 62 sets the allowable-stroke range of the arm cylinder 42 based on the swing angle (the turn position) of the boom 31, the arm 41, and the bucket 51 such that the tip end distance that is a distance between the boom cylinder 32 and the tip end portion 58 of the bucket 51 is kept as the reference distance L1.

In particular, when the operator operates the operating device 19R to move the boom 31 in a direction separating away from the boom reference position S1, the boom controller portion 61 operates the boom 31 according to the operation by the operator. In addition, the arm controller portion 62 sets the allowable-stroke range of the arm cylinder 42 based on the table or the function representing a relation between: the detection results of the turn positions of the boom 31, the arm 41, and the bucket 51 detected by the boom angle sensor 91, the arm angle sensor 92, and the working tool angle sensor 93; and the allowable-stroke ranges stored in advance of the arm cylinder 42 for setting the tip end distance, which is the distance between the tip end portion 58 of the bucket 51 and the boom cylinder 32, to the reference distance L1.

In this manner, by setting the allowable-stroke range of the arm cylinder 42 in consideration of the swing posture (the turn position) of the bucket 51, the arm 41 and the bucket 51 can be moved further closer to the boom 31 side than in the first embodiment.

(2-3. Movement in Direction Approaching Boom Reference Position)

The arm controller portion 62 operates the arm cylinder 42 to retract the arm 41 in the direction separating the tip end portion 58 of the bucket 51 away from the boom cylinder 32 in the case where the boom 31 is turned in a direction to move the boom 31 close to the boom reference position S1, and in the case where the tip end distance that is a distance between the boom cylinder 32 and the tip end portion 58 of the bucket 51 becomes less than the reference distance L1 when only the boom 31 is operated without operating the arm cylinder 42.

In particular, when the operator operates the operating device 19R to move the boom 31 in a direction of approaching the boom reference position S1, the boom controller portion 61 operates the boom 31 according to the operation by the operator. In addition, the arm controller portion 62 judges whether the tip end distance becomes less than the reference distance L1 when the boom 31 is moved without moving the arm cylinder 42 and the bucket 51, based on the detection result of the turn position of the boom 31 by the boom angle sensor 91, on the detection result of the turn position of the boom 31 by the boom angle sensor 91, on the detection result of the turn position of the arm 41 by the arm angle sensor 92, and on the detection result of the turn position of the bucket 51 by the working tool angle sensor 93. When it is determined that the distance becomes less than the reference distance L1, the arm controller portion 62 operates (shortens) the arm cylinder 42 until the tip end distance becomes equal to the reference distance L1, and retracts the arm 41 in the direction of separating the tip end portion 58 of the bucket 51 from the boom cylinder 32. That is, the arm controller portion 62 refers to the table or the function representing the relation between the tip end distance, the stroke of the arm cylinder 42, the turn position of the boom 31, the turn position of the arm 41, and the turn position of the bucket 51, then specifies the stroke amount (the shortening amount) of the arm cylinder 42 for setting the tip end distance to the reference distance L1. In this manner, the arm cylinder 42 is operated according to the specified stroke amount. Thus, this configuration can prevent the boom cylinder 32 and the bucket 51 from interfering with each other.

(2-4. In Movement of Bucket)

In the case when the bucket controller portion 62 turns the bucket 51 in a direction approaching the boom cylinder 32, and in the case where the tip end distance becomes less than the reference distance L1 when the bucket 51 is operated without operating the arm cylinder 42, the arm controller portion 62 moves the arm cylinder 42 to retract the arm 41 in the direction in which the tip end portion 58 of the bucket 51 moves away from the boom cylinder 32.

In particular, when the operator operates the control device 19R to move the bucket 51 toward the boom cylinder 32 (the squeezing operation), the bucket controller portion 63 operates the bucket 51 according to the operation by the operator. In addition, the arm controller portion 62 judges whether the tip end distance becomes less than the reference distance L1 when the bucket 51 is moved without moving the arm cylinder 42, based on the detection result of the turn position of the boom 31 by the boom angle sensor 91, on the detection result of the turn position of the boom 31 by the boom angle sensor 91, on the detection result of the turn position of the arm 41 by the arm angle sensor 92, and on the detection result of the turn position of the bucket 51 by the working tool angle sensor 93. When it is determined that the distance becomes less than the reference distance L1, the arm controller portion 62 operates (shortens) the arm cylinder 42 until the tip end distance becomes equal to the reference distance L1, and retracts the arm 41 in the direction of separating the tip end portion 58 of the bucket 51 from the boom cylinder 32. That is, the arm controller portion 62 refers to the table or the function representing the relation between the tip end distance, the stroke of the arm cylinder 42, the turn position of the boom 31, the turn position of the arm 41, and the turn position of the bucket 51, then specifies the stroke amount (the shortening amount) of the arm cylinder 42 for setting the tip end distance to the reference distance L1. In this manner, the arm cylinder 42 is operated according to the specified stroke amount. Thus, this configuration can prevent the boom cylinder 32 and the bucket 51 from interfering with each other. Even when the boom 31 and the bucket 51 are simultaneously operated (a combined operation), the arm controller portion 62 operates the arm cylinder 42 as needed in the same manner, and thus retracts the arm 41 in the direction of separating the tip end portion 58 of the bucket 51 from the boom cylinder 32.

Third Embodiment

Another embodiment of the present invention will be described below. For convenience of the explanation, members having the same functions as those according to the first embodiment are represented with the same reference numerals, and the description thereof will be omitted.

In the first embodiment, the example in which, regardless of the turn position of the bucket 51, the allowable-stroke range of the arm cylinder 42 is set depending on the turn position of the boom 31 has been described. On the other hand, the present embodiment describes switching between a configuration where the allowable-stroke range of the arm cylinder 42 is set based on the turn position of the boom 31 and a configuration where the allowable-stroke range of the arm cylinder 42 is constant regardless of the turn position of the boom 31.

First, based on the detection result of the swing angle θ4 (the turn position) of the bucket 51 by the working tool angle sensor 93, the arm controller portion 62 judges whether the present turn position of the bucket 51 is in the first range where the tip end portion 58 is arranged closer to the boom cylinder 32 side (the crowding side) than the case where the bucket 51 is arranged at a predetermined position (see FIG. 8) or in a second range where the tip end portion 58 is arranged farther from the boom cylinder 32 side (the dumping side). The above-mentioned predetermined position is not particularly determined, and may be set to, for example, the turn position of the bucket 51 of the case where the control device 19R is set to the neutral position, a position where the tip end portion 58 of the bucket 51 is arranged on the axis line of the arm 41 (on a straight line passing through the center of the horizontal shaft 43 and the center of the horizontal shaft 57), or the center position of the allowable-turn range of the tip end portion 58 of the bucket 51.

Then, when the arm controller portion 62 determines that the current turn position of the bucket 51 is in the first range (closer to the crowding than the predetermined position), the arm controller portion 62 sets the allowable-stroke range of the arm cylinder 42 according to the turn position of the boom 31 in the same method as the method of the first embodiment mentioned above.

Figure 8:
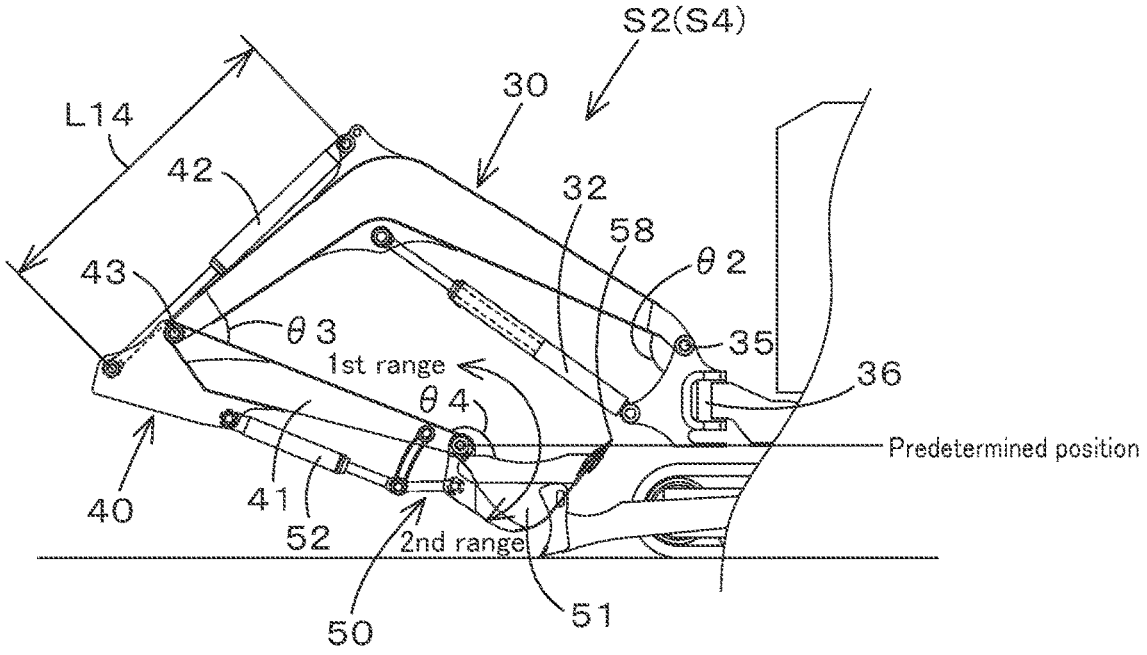
FIG. 8 is a side view of the working machine illustrating a method for judging whether the turn position of the bucket is in a first range where the tip end portion is arranged closer to the boom cylinder side than a predetermined position or in a second range where the tip end portion is arranged far from the boom cylinder than the predetermined position according to the embodiments.

In addition, when the arm controller portion 62 determines that the current turn position of the bucket 51 is in the second range (closer to the dumping side than the predetermined position), the arm controller portion 62 sets the allowable stroke range of the arm cylinder 42 to be constant in the allowable-stroke range where the shortest trajectory distance becomes a second predetermined value shorter than the reference distance L1 at the boom reference position S1. As the result, as shown in FIG. 8, when the current turn position of the bucket 51 is in the second range, the maximum length L14 of the arm cylinder 42 can be set to be longer than the set maximum length L11 of the arm cylinder 42 that is set at the boom swing position S2 (see FIG. 5) in the first embodiment, and the arm 41 and the bucket 51 can be moved further closer to the boom 31 side than in the first embodiment.

In this manner, it is possible to prevent the bucket 51 from coming into contact with the boom cylinder 32, and to sufficiently bring the arm 41 and the bucket 51 toward the boom 31 side regardless of the posture of the boom 31.

In addition, the bucket controller portion 63 sets the allowable turn range of the bucket 51 is set to a predetermined position when the crowding operation of the bucket 51 (an operation to turn the tip end portion 58 of the bucket 51 to the boom cylinder 32 side) is performed from a state where the current turn position of the bucket 51 is in the second range (closer to the dumping side than a predetermined position), and the bucket controller portion 63 stops the movement of the bucket 51 when the turn position of the bucket 51 reaches a predetermined position. In this manner, it is possible to reliably prevent the tip end portion 58 of the bucket 51 from coming into contact with the boom cylinder 32.

In addition, when the arm controller portion 62 determines that the current turn position of the bucket 51 is in the first range (closer to the crowding side than the predetermined position), the arm controller portion 62 may set the allowable stroke range of the arm cylinder 42 to be constant in the allowable-stroke range where the shortest trajectory distance becomes equal to the reference distance L1 at the boom reference position S1 regardless of the turn position of the boom 31. In this manner, when the bucket 51 is in the first range, it is possible to reliably prevent the bucket 51 from coming into contact with the boom cylinder 32, and when the bucket 51 is in the second range, the arm 41 and the bucket 51 can be moved sufficiently closer to the boom 31 regardless of the posture of the boom 31.

Fourth Embodiment

Another embodiment of the present invention will be described below. For convenience of the explanation, members having the same functions as those according to the first embodiment are represented with the same reference numerals, and the description thereof will be omitted.

The third embodiment describes the switching between the configuration where the allowable-stroke range of the arm cylinder 42 is set based on the turn position of the boom 31 and a configuration where the allowable-stroke range of the arm cylinder 42 is constant regardless of the turn position of the boom 31, based on the turn position of the boom 31 and on the turn position of the bucket 51. On the other hand, the present embodiment sets the allowable-stroke range of the arm cylinder 42 based on the turn position of the bucket 51 regardless of the turn position of the boom 31.

First, based on the detection result of the swing angle θ4 (the turn position) of the bucket 51 by the working tool angle sensor 93, the arm controller portion 62 judges whether the current turn position of the bucket 51 is in the first range or in the second range. The method of setting the first range and the second range is the same as in the third embodiment. When the arm controller portion 62 determines that the current turn position of the bucket 51 is in the first range (closer to the crowding side than a predetermined position), the arm controller portion 62 sets the allowable-stroke range of the boom cylinder 42 to be in a fixed range where the shortest trajectory distance becomes equal to the reference distance (a predetermined value) L1 at the boom reference position S1 regardless of the turn position of the boom 31.

In addition, when the arm controller portion 62 determines that the current turn position of the bucket 51 is in the second range (closer to the dumping side than the predetermined position), the arm controller portion 62 sets the allowable-stroke range of the arm cylinder 42 to be in a fixed range where the shortest trajectory distance becomes equal to a second predetermined value shorter than the reference distance L1 at the boom reference position S1. As the result, as shown in FIG. 8, when the current turn position of the bucket 51 is in the second range, the maximum length L14 of the arm cylinder 42 can be set to be longer than the maximum length L11 of the arm cylinder 42 that is set at the boom swing position S2 (see FIG. 5) in the first embodiment. In this manner, the arm 41 and the bucket 51 can be moved further closer to the boom 31 side than in the first embodiment.

As described above, it is possible to prevent the bucket 51 from coming into contact with the boom cylinder 32, and to bring the arm 41 and the bucket 51 sufficiently closer to the boom 31 side regardless of the posture of the boom 31.

In addition, when the cloud operation of the bucket 51 (an operation to turn the tip end portion 58 of the bucket 51 to the boom cylinder 32 side) from the state in which the current turn position of the bucket 51 is in the second range (closer to the dumping side than the predetermined position), the bucket controller portion 63 sets the allowable turn range of the bucket 51 to a predetermined position, and stops the movement of the bucket 51 when the turn position of the bucket 51 reaches a predetermined position. In this manner, it is possible to reliably prevent the tip end portion 58 of the bucket 51 from coming into contact with the boom cylinder 32.

SUMMARY

As described above, the working machine 1 according to one aspect of the present invention includes: the machine body; the boom pivotally having a base end portion pivotally supported by the machine body to turn about a first turn shaft; the boom cylinder to turn the boom around the first turn shaft, the boom cylinder being arranged on one surface side of the boom; the arm having a base end portion pivotally supported by a tip end portion of the boom to turn about a second turn shaft parallel to the first turn shaft; the arm cylinder to turn the arm about the second turn shaft, the arm cylinder being arranged on the other surface side of the boom; and the working tool pivotally supported by a tip end portion of the arm to turn about a third turn shaft parallel to the first turn shaft. The working machine includes the controller device to set an allowable-stroke range of the arm cylinder moving the arm toward the boom depending on a turn position of the boom such that a shortest trajectory distance that is a shortest distance between the boom cylinder and a turn trajectory of the tip end portion of the working tool about the third turn shaft is kept at a predetermined value even when the turn position of the boom changes, in a case where the boom is turned in a direction separating from a boom reference position. The boom reference position is the turn position of the boom where a first straight line connecting the first turn shaft and a fourth turn shaft is perpendicular to a second straight line parallel to an extending direction of the boom cylinder, the fourth turn shaft being provided on the base end portion side of the boom and rotatably supporting the boom cylinder.

According to the above configuration, by setting the allowable-stroke range of the arm cylinder according to the turn position of the boom so that the shortest trajectory distance is kept at a predetermined value even when the turn position of the boom changes, the arm and the working tool can be moved sufficiently close to the boom side regardless of a posture of the boom.

In addition, the controller device sets the allowable-stroke range of the arm cylinder to be longer as the boom is turned in the direction separating from the boom reference position.

According to the above configuration, the arm and the working tool can be moved sufficiently close to the boom side regardless of a posture of the boom.

In addition, the working machine includes: the boom sensor to detect the turn position of the boom about the first turn shaft; and the arm sensor to detect the turn position of the boom about the second turn shaft. The controller device moves the arm cylinder to turn the arm to a position where the shortest trajectory distance is equal to or more than the predetermined value in a case where the shortest trajectory distance is less than the predetermined value when the boom is turned with the stroke of the arm cylinder constant in turning the boom in a direction approaching the boom reference position.

According to the above-mentioned configuration, the working tool can be appropriately prevented from coming into contact with the a boom cylinder.

In addition, the working machine includes the working tool sensor to detect whether the turn position of the working tool about the third turn shaft is in a first range where the tip end portion of the working tool is arranged closer to the boom cylinder side than a predetermined position or in a second range where the tip end portion of the working tool is arranged far from the boom cylinder than the predetermined position. The controller device sets, depending on the turn position of the boom, the allowable-stroke range of the arm cylinder where the arm approaches the boom such that the shortest trajectory distance is equal to the predetermined value even when the turn position of the boom changes under the state where the turn position of the working tool is in the first range, and sets, depending on the turn position of the boom, the allowable-stroke range of the arm cylinder where the arm approaches the boom such that the shortest trajectory distance is equal to a second predetermined value smaller than the predetermined value even when the turn position of the boom changes under the state where the turn position of the working tool is in the second range.

A working machine according to another aspect of the present invention includes: the machine body; the boom pivotally having a base end portion pivotally supported by the machine body to turn about a first turn shaft; the boom cylinder to turn the boom around the first turn shaft, the boom cylinder being arranged on one surface side of the boom; the arm having a base end portion pivotally supported by a tip end portion of the boom to turn about a second turn shaft parallel to the first turn shaft; an arm cylinder to turn the arm about the second turn shaft, the arm cylinder being arranged on the other surface side of the boom; a working tool pivotally supported by a tip end portion of the arm to turn about a third turn shaft parallel to the first turn shaft; and a working tool sensor to detect whether the turn position of the working tool about the third turn shaft is in a first range where the tip end portion of the working tool is arranged closer to the boom cylinder side than a predetermined position or in a second range where the tip end portion of the working tool is arranged far from the boom cylinder than the predetermined position. The working machine includes a controller device to set, regardless of the turn position of the boom, the allowable-stroke range of the arm cylinder where the arm approaches the boom to a fixed range where the shortest trajectory distance is equal to a predetermined value at the boom reference position when the turn position of the working tool is in the first range and to set, regardless of the turn position of the boom, the allowable-stroke range of the arm cylinder where the arm approaches the boom to another fixed range where the shortest trajectory distance is equal to a second predetermined value smaller than the predetermined value at the boom reference position when the turn position of the working tool is in the second range. The boom reference position is the turn position of the boom where a first straight line connecting the first turn shaft and a fourth turn shaft is perpendicular to a second straight line parallel to an extending direction of the boom cylinder, the fourth turn shaft being provided on the base end portion side of the boom and rotatably supporting the boom cylinder. The shortest trajectory distance is the shortest distance between the boom cylinder and a turn trajectory of the tip and portion of the working tool about the third turn shaft.

According to each of the above configurations, it is possible to appropriately prevent the working tool from coming into contact with the boom cylinder with a simple configuration, and the arm and the working tool can be moved sufficiently close to the boom side regardless of a posture of the boom.

In addition, the controller device limits the allowable-stroke range of the working tool cylinder to a range where the tip end portion of the working tool does not enter the first range side in a case where the shortest trajectory distance is smaller than a predetermined value and the working tool is turned from a state where the working tool is in the second range in a direction approaching the first range.

According to the configuration mentioned above, the working tool can be appropriately prevented from coming into contact with the boom cylinder.

A working machine according to further another aspect of the present invention includes: a machine body; a boom pivotally having a base end portion pivotally supported by the machine body to turn about a first turn shaft; a boom cylinder to turn the boom around the first turn shaft, the boom cylinder being arranged on one surface side of the boom; an arm having a base end portion pivotally supported by a tip end portion of the boom to turn about a second turn shaft parallel to the first turn shaft; an arm cylinder to turn the arm about the second turn shaft, the arm cylinder being arranged on the other surface side of the boom; and a working tool pivotally supported by a tip end portion of the arm to turn about a third turn shaft parallel to the first turn shaft. The working machine includes a controller device to set an allowable-stroke range of the arm cylinder moving the arm toward the boom depending on a turn position of the boom and a turn position of the working tool such that a tip end distance that is the shortest distance between the boom cylinder and the tip end portion of the working tool is kept at a predetermined value even when the turn position of the boom changes, in a case where the boom is turned in a direction separating from a boom reference position. The boom reference position is the turn position of the boom where a first straight line connecting the first turn shaft and a fourth turn shaft is perpendicular to a second straight line parallel to an extending direction of the boom cylinder, the fourth turn shaft being provided on the base end portion side of the boom and rotatably supporting the boom cylinder.

According to the configuration mentioned above, the allowable-stroke range of the arm cylinder is set according to the turn position of the boom and the turn position of the working tool so that the shortest trajectory distance is kept at a predetermined value even when the turn position of the boom changes, and thereby the arm and the working tool can be moved sufficiently close to the boom side regardless of a posture of the boom.

In addition, the controller device moves the arm cylinder to turn the arm to a position where the tip end distance is equal to or more than the predetermined value in a case where the tip end distance is less than the predetermined value when the working tool is turned with the stroke of the arm cylinder constant in turning the working tool in a direction where the tip end portion of the working tool approaches the boom cylinder.

According to the configuration mentioned above, the working tool can be appropriately prevented from coming into contact with the boom cylinder.

In addition, the controller device moves the arm cylinder to turn the arm to a position where the tip end distance is equal to or more than the predetermined value in a case where the tip end distance is less than the predetermined value when the boom is turned with the turn position of the working tool constant in turning the boom in a direction approaching the boom reference position.

According to the configuration mentioned above, the working tool can be appropriately prevented from coming into contact with the boom cylinder.

In addition, the controller device restricts a movement speed of the arm cylinder when the arm cylinder is stroked over the allowable-stroke range in the boom reference position.

According to the configuration mentioned above, a movement speed of the arm cylinder is reduced in the vicinity of termination of the allowable-stroke range of the arm cylinder, and thereby it is possible to prevent vibration or impact from being caused by the sudden stopping of the movement of the arm.

According to an aspect of the present invention, a control method of a working machine including: a machine body; a boom pivotally having a base end portion pivotally supported by the machine body to turn about a first turn shaft; a boom cylinder to turn the boom around the first turn shaft, the boom cylinder being arranged on one surface side of the boom; an arm having a base end portion pivotally supported by a tip end portion of the boom to turn about a second turn shaft parallel to the first turn shaft; an arm cylinder to turn the arm about the second turn shaft, the arm cylinder being arranged on the other surface side of the boom; and a working tool pivotally supported by a tip end portion of the arm to turn about a third turn shaft parallel to the first turn shaft, comprises setting an allowable-stroke range of the arm cylinder moving the arm toward the boom depending on a turn position of the boom such that a shortest trajectory distance that is a shortest distance between the boom cylinder and a turn trajectory of the tip end portion of the working tool about the third turn shaft is kept at a predetermined value even when the turn position of the boom changes, in a case where the boom is turned in a direction separating from a boom reference position, wherein the boom reference position is the turn position of the boom where a first straight line connecting the first turn shaft and a fourth turn shaft is perpendicular to a second straight line parallel to an extending direction of the boom cylinder, the fourth turn shaft being provided on the base end portion side of the boom and rotatably supporting the boom cylinder.

According to another aspect of the present invention, a control method of a working machine including: a machine body; a boom pivotally having a base end portion pivotally supported by the machine body to turn about a first turn shaft; a boom cylinder to turn the boom around the first turn shaft, the boom cylinder being arranged on one surface side of the boom; an arm having a base end portion pivotally supported by a tip end portion of the boom to turn about a second turn shaft parallel to the first turn shaft; an arm cylinder to turn the arm about the second turn shaft, the arm cylinder being arranged on the other surface side of the boom; a working tool pivotally supported by a tip end portion of the arm to turn about a third turn shaft parallel to the first turn shaft; and a working tool sensor to detect whether the turn position of the working tool about the third turn shaft is in a first range where the tip end portion of the working tool is arranged closer to the boom cylinder side than a predetermined position or in a second range where the tip end portion of the working tool is arranged far from the boom cylinder than the predetermined position, comprises setting, regardless of the turn position of the boom, the allowable-stroke range of the arm cylinder where the arm approaches the boom to a fixed range where the shortest trajectory distance is equal to a predetermined value at the boom reference position when the turn position of the working tool is in the first range and to set, regardless of the turn position of the boom, the allowable-stroke range of the arm cylinder where the arm approaches the boom to another fixed range where the shortest trajectory distance is equal to a second predetermined value smaller than the predetermined value at the boom reference position when the turn position of the working tool is in the second range, wherein the boom reference position is the turn position of the boom where a first straight line connecting the first turn shaft and a fourth turn shaft is perpendicular to a second straight line parallel to an extending direction of the boom cylinder, the fourth turn shaft being provided on the base end portion side of the boom and rotatably supporting the boom cylinder. The shortest trajectory distance is the shortest distance between the boom cylinder and a turn trajectory of the tip and portion of the working tool about the third turn shaft.

According to further another aspect of the present invention, a control method of a working machine including: a machine body; a boom pivotally having a base end portion pivotally supported by the machine body to turn about a first turn shaft; a boom cylinder to turn the boom around the first turn shaft, the boom cylinder being arranged on one surface side of the boom; an arm having a base end portion pivotally supported by a tip end portion of the boom to turn about a second turn shaft parallel to the first turn shaft; an arm cylinder to turn the arm about the second turn shaft, the arm cylinder being arranged on the other surface side of the boom; and a working tool pivotally supported by a tip end portion of the arm to turn about a third turn shaft parallel to the first turn shaft, comprises setting an allowable-stroke range of the arm cylinder moving the arm toward the boom depending on a turn position of the boom and a turn position of the working tool such that a tip end distance that is the shortest distance between the boom cylinder and the tip end portion of the working tool is kept at a predetermined value even when the turn position of the boom changes, in a case where the boom is turned in a direction separating from a boom reference position, wherein the boom reference position is the turn position of the boom where a first straight line connecting the first turn shaft and a fourth turn shaft is perpendicular to a second straight line parallel to an extending direction of the boom cylinder, the fourth turn shaft being provided on the base end portion side of the boom and rotatably supporting the boom cylinder.

The controller device provided in each of the working machines described above may be realized by a computer. In this case, the scope of the present invention includes a computer program realizing the controller device as the computer and a storage medium storing the computer program in a computer-readable form.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A working machine of a one-piece boom type, including:

a machine body;

a boom pivotally having a base end portion pivotally supported by the machine body to turn about a first turn shaft;

a boom cylinder to turn the boom around the first turn shaft, the boom cylinder being arranged on one surface side of the boom;

an arm having a second base end portion pivotally supported by a tip end portion of the boom to tum about a second turn shaft parallel to the first turn shaft;

an arm cylinder to tum the arm about the second tum shaft, the arm cylinder being arranged on another surface side of the boom; and a working tool pivotally supported by a second tip end portion of the arm to turn about a third turn shaft parallel to the first turn shaft, comprising a controller device to set an allowable-stroke range of the arm cylinder moving the arm toward the boom depending on a tum position of the boom such that a shortest trajectory distance between the boom cylinder and a tum trajectory of a third tip end portion of the working tool about the third turn shaft is kept constantly at a reference distance even when the turn position of the boom changes, in a case where the boom is turned in a direction separating from a boom reference position, the reference distance being a distance set to prevent contact between the third tip end portion of the working tool and the boom cylinder when the boom is in the boom reference position, wherein the boom reference position is the tum position of the boom where a first straight line connecting the first turn shaft and a fourth tum shaft is perpendicular to a second straight line parallel to an extending direction of the boom cylinder, the fourth turn shaft being provided on the base end portion side of the boom and rotatably supporting the boom cylinder, the controller device sets based on a detection result of the tum position of the boom detected by a boom sensor and on a preliminarily stored table or function showing a relationship between the turn position of the boom and the allowable-stroke range of the arm cylinder for setting the shortest trajectory distance to the reference distance, the allowable-stroke range of the arm cylinder that corresponds to the tum position of the boom indicated by the detection result in the case where the boom is turned in the direction separating from the boom reference position, and when an operator operates the arm in a direction to bring the arm toward the boom cylinder with an operating device at the tum position of the boom indicated by the detection result, allows the arm cylinder to extend until the shortest trajectory distance reaches the reference distance, and limits the allowable-stroke range of the arm cylinder such that the shortest trajectory distance does not become less than the reference distance.

2. The working machine according to claim 1, wherein the controller device sets the allowable-stroke range of the arm cylinder to be extended as the boom is turned further in the direction separating from the boom reference position.

3. The working machine according to claim 1, further comprising:

the boom sensor to detect the tum position of the boom about the first tum shaft; and an arm sensor to detect a tum position of the arm about the second turn shaft, wherein the controller device moves the arm cylinder to turn the arm to a position where the shortest trajectory distance is equal to or more than the reference distance in a case where the shortest trajectory distance is less than the reference distance when the boom is turned with a constant stroke of the arm cylinder in turning the boom in a second direction approaching the boom reference position.

4. The working machine according to claim 1, further comprising:

a working tool sensor to detect whether the turn position of the working tool about the third turn shaft is in a first range where the third tip end portion of the working tool is arranged upward of a predetermined position or in a second range where the third tip end portion of the working tool is arranged downward of the predetermined position, wherein the controller device sets, depending on the turn position of the boom, the allowable-stroke range of the arm cylinder where the arm approaches the boom such that the shortest trajectory distance is constantly equal to the reference distance even when the turn position of the boom changes under a state where the turn position of the working tool is in the first range, and sets, depending on the turn position of the boom, the allowable-stroke range of the arm cylinder where the arm approaches the boom such that the shortest trajectory distance is constantly equal to a second reference distance smaller than the reference distance even when the turn position of the boom changes under a second state where the turn position of the working tool is in the second range.

5. The working machine according to claim 4, wherein the controller device limits the allowable-stroke range of a working tool cylinder to a range where the third tip end portion of the working tool does not enter the first range in a case where the shortest trajectory distance is smaller than the second reference distance and the working tool is turned from a state where the working tool is in the second range in a direction approaching the first range.

6. The working machine according to claim 1, wherein the controller device restricts a movement speed of the arm cylinder when the arm cylinder is stroked over the allowable-stroke range in the boom reference position.

7. A working machine of one-piece boom type, including:

a machine body;

a boom pivotally having a base end portion pivotally supported by the machine body to turn about a first turn shaft;

a boom cylinder to turn the boom around the first turn shaft, the boom cylinder being arranged on one surface side of the boom;

an arm having a second base end portion pivotally supported by a tip end portion of the boom to tum about a second turn shaft parallel to the first turn shaft;

an arm cylinder to turn the arm about the second turn shaft, the arm cylinder being arranged on another surface side of the boom;

a working tool pivotally supported by a second tip end portion of the arm to tum about a third turn shaft parallel to the first turn shaft; and a working tool sensor to detect a turn position of the working tool about the third turn shaft, comprising a controller device to set an allowable-stroke range of the arm cylinder moving the arm toward the boom depending on a turn position of the boom and the turn position of the working tool such that a tip end distance between the boom cylinder and a third tip end portion of the working tool is kept constantly at a reference distance even when the tum position of the boom changes, in a case where the boom is turned in a direction separating from a boom reference position, the reference distance being a distance set to prevent contact between the third tip end portion of the working tool and the boom cylinder when the boom is in the boom reference position, wherein the boom reference position is the turn position of the boom where a first straight line connecting the first turn shaft and a fourth turn shaft is perpendicular to a second straight line parallel to an extending direction of the boom cylinder, the fourth turn shaft being provided on the base end portion side of the boom and rotatably supporting the boom cylinder, and the controller device sets, based on: a detection result of the tum position of the boom detected by a boom sensor; a detection result of a tum position of the arm detected by an arm sensor, a detection result of the turn position of the working tool detected by the working tool sensor; and a table or function stored in advance representing a relation between the turn position of the boom, the turn position of the working tool, and the allowable-stroke range of the arm cylinder for setting the tip end distance to the reference distance, the allowable-stroke range of the arm cylinder that corresponds to the tum position of the boom indicated by the detection result, the turn position of the arm indicated by the detection result and the turn position of the working tool indicated by the detection result, in the case where the boom is turned in the direction separating from the boom reference position, and when an operator operates the arm in a direction to bring the arm towards the boom cylinder with an operating device at the turn position of the boom indicated by the detection result, the turn position of the arm indicated by the detection result, and the turn position of the working tool indicated by the detection result allows the arm cylinder to extend until the tip end distance reaches the reference distance, and limits the allowable-stroke range of the arm cylinder such that the tip end distance does not become less than the reference distance.

8. The working machine according to claim 7, wherein the controller device moves the arm cylinder to turn the arm to a position where the tip end distance is equal to or more than the reference distance in a case where the tip end distance is less than the reference distance when the working tool is turned with a constant stroke of the arm cylinder in turning the working tool in a direction where the third tip end portion of the working tool approaches the boom cylinder.

9. The working machine according to claim 8, wherein the controller device moves the arm cylinder to turn the arm to a position where the tip end distance is equal to or more than the reference distance in a case where the tip end distance is less than the reference distance when the boom is turned with the turn position of a working tool constant in turning the boom in a second direction approaching the boom reference position.

10. A control method of a working machine of a one-piece boom type including: a machine body; a boom pivotally having a base end portion pivotally supported by the machine body to tum about a first turn shaft; a boom cylinder to turn the boom around the first tum shaft, the boom cylinder being arranged on one surface side of the boom; an arm having a second base end portion pivotally supported by a tip end portion of the boom to turn about a second turn shaft parallel to the first turn shaft; an arm cylinder to tum the arm about the second tum shaft, the arm cylinder being arranged on another surface side of the boom; and a working tool pivotally supported by a second tip end portion of the arm to turn about a third turn shaft parallel to the first turn shaft, comprising setting an allowable-stroke range of the arm cylinder moving the arm toward the boom depending on a turn position of the boom such that a shortest trajectory distance between the boom cylinder and a turn trajectory of a third tip end portion of the working tool about the third turn shaft is kept constantly at a reference distance even when the turn position of the boom changes, in a case where the boom is turned in a direction separating from a boom reference position, the reference distance being a distance set to prevent contact between the third tip end portion of the working tool and the boom cylinder when the boom is in the boom reference position, wherein the boom reference position is the turn position of the boom where a first straight line connecting the first turn shaft and a fourth turn shaft is perpendicular to a second straight line parallel to an extending direction of the boom cylinder, the fourth turn shaft being provided on the base end portion side of the boom and rotatably supporting the boom cylinder, and causing a controller device to set, based on a detection result of the turn position of the boom detected by a boom sensor and on a preliminarily stored table or function showing a relationship between the turn position of the boom and the allowable stroke range of the arm cylinder for setting the shortest trajectory distance to the reference distance, the allowable-stroke range of the arm cylinder that corresponds to the turn position of the boom indicated by the detection result in the case where the boom is turned in the direction separating from the boom reference position, and when an operator operates the arm in a direction to bring the arm towards the boom cylinder with an operating device at the turn position of the boom indicated by the detection result, allow the arm cylinder to extend until the shortest trajectory distance reaches the reference distance, and limit the allowable-stroke range of the arm cylinder such that the shortest trajectory distance does not become less than the reference distance.

* * * * *